US009896629B2

(12) United States Patent
Koseoglu

(10) Patent No.: US 9,896,629 B2
(45) Date of Patent: Feb. 20, 2018

(54) INTEGRATED PROCESS TO PRODUCE ASPHALT, PETROLEUM GREEN COKE, AND LIQUID AND GAS COKING UNIT PRODUCTS

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 83 days.

(21) Appl. No.: 14/809,594

(22) Filed: Jul. 27, 2015

(65) Prior Publication Data

US 2016/0010005 A1 Jan. 14, 2016

Related U.S. Application Data

(60) Provisional application No. 62/028,892, filed on Jul. 25, 2014.

(51) Int. Cl.
*C10G 55/04* (2006.01)
*C10B 57/04* (2006.01)

(52) U.S. Cl.
CPC ..... *C10G 55/04* (2013.01); *C10B 57/045* (2013.01)

(58) Field of Classification Search
CPC ..... C10G 55/04; C10B 57/045
See application file for complete search history.

(56) References Cited

U.S. PATENT DOCUMENTS

| | | | | |
|---|---|---|---|---|
| 1,148,011 A | | 7/1915 | Davies et al. | |
| 2,327,247 A | | 5/1939 | Carr et al. | |
| 2,337,448 A | | 1/1940 | Carr | |
| 2,277,842 A | | 3/1942 | Bray | |
| 2,682,494 A | * | 6/1954 | Weikart | C10G 53/14 191/74 |
| 2,940,920 A | | 6/1960 | Garwin | |

(Continued)

FOREIGN PATENT DOCUMENTS

| | | |
|---|---|---|
| CA | 1140886 A | 2/1983 |
| CA | 1159788 A | 1/1984 |

(Continued)

OTHER PUBLICATIONS

Buchanan, David et al., "The Effect of Air Oxidation on Sequential Solvent Extraction of the Argonne Premium Coal Samples," ACS Meeting 1987, pp. 293-300 (Sep. 9, 1987).

(Continued)

*Primary Examiner* — Randy Boyer
*Assistant Examiner* — Juan Valencia
(74) *Attorney, Agent, or Firm* — Abelman, Frayne & Schwab

(57) ABSTRACT

An integrated process is provided to produce asphalt, high quality petroleum green coke, and liquid and gas coker unit products. Sulfur molecules contained in heavy petroleum fractions, including organosulfur molecules, and in certain embodiments organonitrogen molecules are oxidized. The polar oxidized sulfur compounds shift from the oil phase to the asphalt phase. The deasphalted/desulfurized oil phase is passed to a coker unit to produce liquid and gas coker products as an effluent stream and recover high quality petroleum green coke.

20 Claims, 1 Drawing Sheet

(56) References Cited

U.S. PATENT DOCUMENTS

| | | | | |
|---|---|---|---|---|
| 2,970,956 | A | 2/1961 | Shiah | |
| 3,003,946 | A | 10/1961 | Garwin | |
| 3,236,883 | A | 2/1966 | Losch | |
| 3,278,562 | A | 10/1966 | Thigpen et al. | |
| 3,380,912 | A | 4/1968 | Paterson et al. | |
| 3,719,589 | A | 3/1973 | Herbstman et al. | |
| 4,097,364 | A | 6/1978 | Egan | |
| 4,097,520 | A | 6/1978 | Slattery | |
| 4,113,661 | A | 9/1978 | Tamm | |
| 4,239,616 | A | 12/1980 | Gearhart | |
| 4,290,880 | A | 9/1981 | Leonard | |
| 4,305,814 | A | 12/1981 | Leonard | |
| 4,411,790 | A | 10/1983 | Arod et al. | |
| 4,430,203 | A | 2/1984 | Cash | |
| 4,482,453 | A | 11/1984 | Coombs et al. | |
| 4,502,944 | A | 3/1985 | Nelson | |
| 4,572,781 | A | 2/1986 | Krasuk et al. | |
| 4,601,816 | A | 7/1986 | Rankel | |
| 4,639,308 | A | 1/1987 | Lee | |
| 4,663,028 | A | 5/1987 | Ditman | |
| 4,747,936 | A | 5/1988 | Penning | |
| 4,757,042 | A | 7/1988 | Threlkel | |
| 4,810,367 | A | 3/1989 | Chomabart et al. | |
| 4,816,140 | A | 3/1989 | Trambouze et al. | |
| 4,883,581 | A | 11/1989 | Dickakian | |
| 4,933,067 | A | 6/1990 | Rankel | |
| 4,976,848 | A | 12/1990 | Johnson | |
| 4,990,243 | A | 2/1991 | Winslow et al. | |
| 5,059,304 | A | 10/1991 | Field | |
| 5,071,805 | A | 12/1991 | Winslow et al. | |
| 5,190,642 | A | 3/1993 | Wilson et al. | |
| 5,294,332 | A | 3/1994 | Klotz | |
| 5,324,417 | A | 6/1994 | Harandi | |
| 5,770,761 | A | 6/1998 | Lin et al. | |
| 6,160,193 | A | 12/2000 | Gore | |
| 6,171,478 | B1 | 1/2001 | Cabrera et al. | |
| 6,180,557 | B1 | 1/2001 | Choudhary et al. | |
| 6,274,785 | B1 | 8/2001 | Gore | |
| 6,277,271 | B1 | 8/2001 | Kocal | |
| 6,332,975 | B1 * | 12/2001 | Abdel-Halim | C10G 55/04 208/131 |
| 6,402,940 | B1 | 6/2002 | Rappas | |
| 6,406,616 | B1 | 6/2002 | Rappas et al. | |
| 6,596,914 | B2 | 7/2003 | Gore et al. | |
| 6,673,235 | B2 | 1/2004 | Harris et al. | |
| 7,566,634 | B2 | 7/2009 | Beyne et al. | |
| 7,820,031 | B2 | 10/2010 | D'Alessandro et al. | |
| 2002/0029997 | A1 | 3/2002 | Rappas et al. | |
| 2002/0035306 | A1 | 3/2002 | Gore et al. | |
| 2003/0094400 | A1 | 5/2003 | Levy et al. | |
| 2003/0136707 | A1 | 7/2003 | Harris et al. | |
| 2004/0178122 | A1 | 9/2004 | Karas et al. | |
| 2005/0183989 | A1 | 8/2005 | Christensen | |
| 2006/0027488 | A1 | 2/2006 | Gauthier | |
| 2006/0060506 | A1 * | 3/2006 | Siskin | C10B 55/00 208/131 |
| 2006/0131214 | A1 | 6/2006 | De Souza et al. | |
| 2007/0138060 | A1 | 6/2007 | Palmer et al. | |
| 2007/0151901 | A1 | 7/2007 | Sain et al. | |
| 2012/0055843 | A1 | 3/2012 | Bourane et al. | |
| 2012/0055845 | A1 * | 3/2012 | Bourane | C10B 55/00 208/90 |

FOREIGN PATENT DOCUMENTS

| | | | |
|---|---|---|---|
| EP | 0097055 | A2 | 12/1983 |
| EP | 056324 | A1 | 10/1993 |
| EP | 1674158 | A1 | 6/2006 |
| GB | 2012809 | A | 8/1979 |
| WO | 2003014266 | A1 | 2/2003 |
| WO | 2005012458 | A1 | 2/2005 |
| WO | 2006071793 | A1 | 7/2006 |
| WO | 2007103440 | A2 | 9/2007 |
| WO | 2007106943 | A1 | 9/2007 |
| WO | 2008048309 | A2 | 4/2008 |

OTHER PUBLICATIONS

Shiraishi, Yashurio, "Desulfurization of Vacuum Gas Oil Based on Chemical Oxidation Followed by Liquid-Liquid Extraction," Energy & Fuels 18 (1), pp. 37-40 (Nov. 21, 2003).

Furimsky, Edwards, "Chapter 2: Properties of Heavy Feeds," Studies in Surface Science and Catalysis, vol. 169, Catalysts for Upgrading Heavy Petroleum Feed, pp. 5-22 (2007).

PCT Application No. PCT/US2015/042234, International Seach Report and Written Opinion dated Oct. 14, 2015 (11 Pages).

* cited by examiner

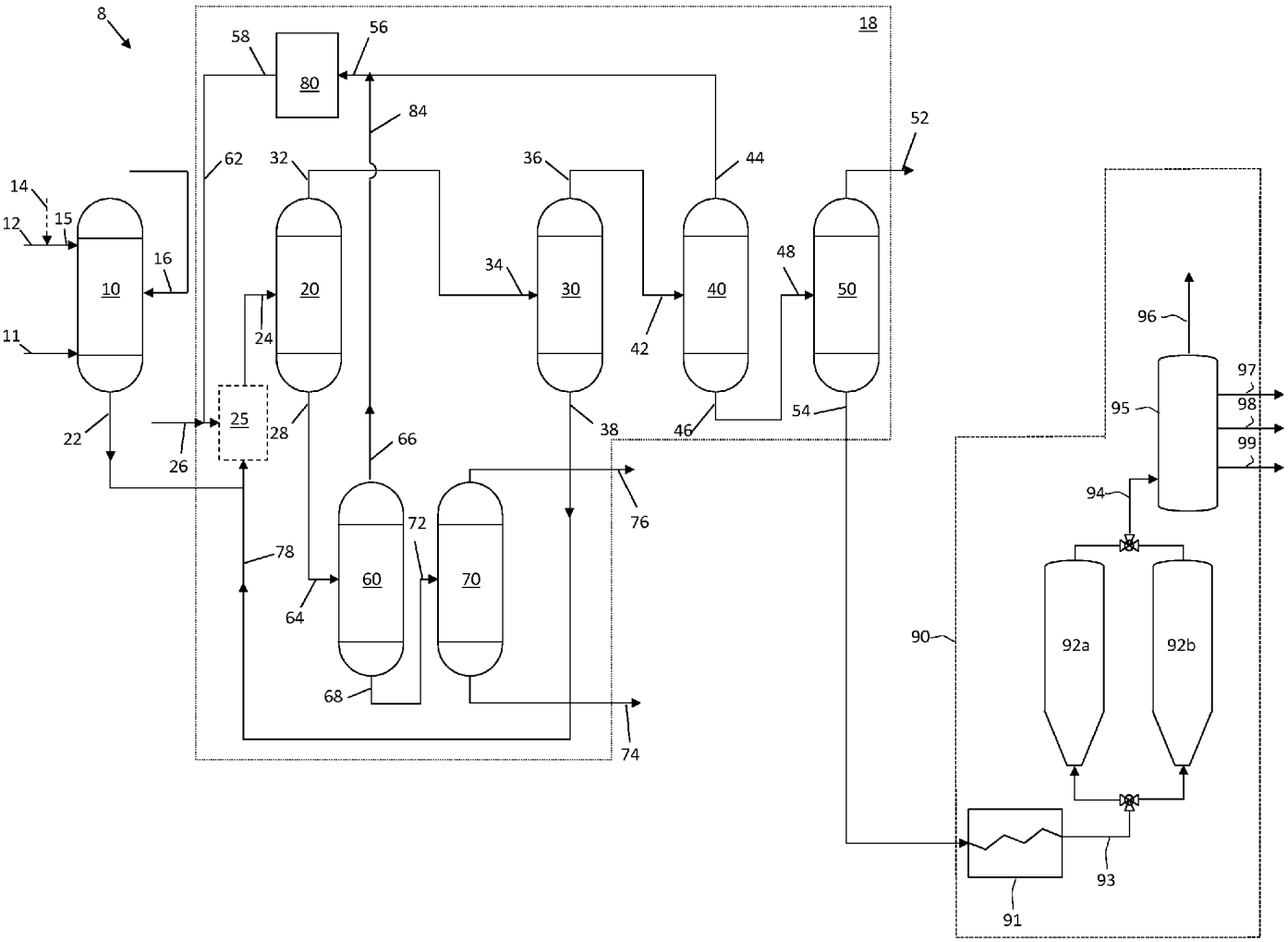
8
10
11
12
14
15
16
18
20
22
24
25
26
28
30
32
34
36
38
40
42
44
46
48
50
52
54
56
58
60
62
64
66
68
70
72
74
76
78
80
84
90
91
92a
92b
93
94
95
96
97
98
99

INTEGRATED PROCESS TO PRODUCE ASPHALT, PETROLEUM GREEN COKE, AND LIQUID AND GAS COKING UNIT PRODUCTS

RELATED APPLICATIONS

This application claims the benefit of U.S. Provisional Patent Application No. 62/028,892 filed Jul. 25, 2014, the disclosure of which is hereby incorporated by reference.

BACKGROUND OF THE INVENTION

Field of the Invention

This invention relates to integrated processes and systems for production of asphalt, high quality petroleum green coke, and liquid and gas coking unit products.

Description of Related Art

Crude oils contain heteroatomic molecules, including polyaromatic molecules, with heteroatomic constituents such as sulfur, nitrogen, nickel, vanadium and others in quantities that impact the refinery processing of the crude oils fractions. Light crude oils or condensates have sulfur concentrations as low as 0.01 percent by weight (W %), in contrast, heavy crude oils and heavy petroleum fractions have sulfur concentrations as high as 5-6 W %. Similarly, the nitrogen content of crude oils is in the range 0.001-1.0 W %. The heteroatom contents of various Saudi Arabian crude oils are given in Table 1. As seen, the heteroatom content of the crude oils within the same family increases with decreasing API gravity on increasing heaviness. The heteroatom content of the crude oil fractions also increases with increasing boiling point (Table 2).

TABLE 1

| Property | ASL | AEL | AL | AM | AH |
|---|---|---|---|---|---|
| Gravity, ° | 51.4 | 39.5 | 33.0 | 31.1 | 27.6 |
| Sulfur, W % | 0.05 | 1.07 | 1.83 | 2.42 | 2.94 |
| Nitrogen, ppmw | 70 | 446 | 1064 | 1417 | 1651 |
| RCR, W % | 0.51 | 1.72 | 3.87 | 5.27 | 7.62 |
| Ni + V, ppmw | <0.1 | 2.9 | 21 | 34.0 | 67 |

ASL—Arab Super Light
AEL—Arab Extra Light
AL—Arab Light
AM—Arab Medium
AH—Arab Heavy

TABLE 2

| Fractions, ° C. | Sulfur W % | Nitrogen ppmw |
|---|---|---|
| $C_5$-90 | 0.01 | |
| 93-160 | 0.03 | |
| 160-204 | 0.06 | |
| 204-260 | 0.34 | |
| 260-315 | 1.11 | |
| 315-370 | 2.00 | 253 |
| 370-430 | 2.06 | 412 |
| 430-482 | 2.65 | 848 |
| 482-570 | 3.09 | 1337 |

Contaminants (poisonous compounds) such as sulfur, nitrogen, poly-nuclear aromatics in the crude oil fractions impact the downstream processes including hydrotreating, hydrocracking and fluid catalytic cracking (FCC). The contaminants are present in the crude oil fractions in varying structures and concentrations. These impurities must be removed during the refining to meet the environmental regulations for the final products (e.g., gasoline, diesel, fuel oil) or for the intermediate refining streams that need to be processed for further upgrading such as reforming isomerization. Contaminants such as nitrogen, sulfur and heavy metals are known to deactivate or poison catalysts.

In conventional refining schemes, crude oil is first in an atmospheric column to separate sour gas and light hydrocarbons including methane, ethane, propane, butanes and hydrogen sulfide, naphtha (36-180° C.), kerosene (180-240° C.), gas oil (240-370° C.) and atmospheric residue bottoms which include hydrocarbons boiling above 370° C.

The atmospheric residue from the atmospheric distillation column is either used as fuel oil or sent to a vacuum distillation unit, depending on the configuration of the refinery. In configurations in which the bottoms are further distilled in a vacuum distillation column, products obtained include vacuum gas oil having hydrocarbons boiling in the range 370-520° C. and vacuum residue having hydrocarbons boiling above 520° C.

As the boiling point of the petroleum fractions increases, the quality of oil decreases and negatively impacts the downstream processing units. Table 3 and Table 4 provide quality of atmospheric (boiling above 370° C.) and vacuum residual (boiling above 520° C.) oils derived from various crude sources. It is clearly shown in these tables that the atmospheric or vacuum residues are highly contaminated with heteroatoms and have high Condranson carbon residue content and the quality deteriorates with decreasing API Gravity.

TABLE 3

| Source | name | API Gravity, ° | Sulfur, W % | Ni + V, ppmw | CCR, W % |
|---|---|---|---|---|---|
| Middle East | Arabian Light | 16.80 | 3.14 | 550.00 | 7.60 |
| Middle East | Arabian Heavy | 12.70 | 4.30 | 125.00 | 13.20 |
| South Asia | Mina | 26.40 | 0.15 | 16.00 | 4.20 |
| South Asia | Duri | 17.50 | 0.22 | 17.00 | 9.30 |
| China | Shengli | 18.70 | 1.23 | 19.00 | 8.60 |
| China | Taching | 25.10 | 0.13 | 4.00 | 4.00 |
| Latin America | Maya | 8.30 | 4.82 | 494.00 | 17.40 |
| Latin America | Isthmus | 13.90 | 2.96 | 53.00 | 8.20 |

TABLE 4

| source | name | API Gravity, ° | Sulfur, W % | Ni + V, ppmw | CCR, W % |
|---|---|---|---|---|---|
| Middle East | Arabian Light | 6.90 | 4.34 | 141.00 | 20.30 |
| Middle East | Arabian Heavy | 3.00 | 6.00 | 269.00 | 27.70 |
| South Asia | Mina | 17.30 | 0.19 | 44.00 | 10.40 |
| South Asia | Duri | 13.00 | 0.25 | 32.00 | 15.20 |
| China | Shengli | 11.70 | 1.66 | 28.00 | 16.40 |
| China | Taching | 18.70 | 0.18 | 9.00 | 9.50 |
| Latin America | Maya | −0.10 | 5.98 | 835.00 | 29.60 |
| Latin America | Isthmus | 4.00 | 4.09 | 143.00 | 21.10 |

Naphtha, kerosene and gas oil streams from crude oils or other natural sources such as shale oils, bitumens and tar sands, are treated to remove the contaminants mainly sulfur, whose quantity exceeds the specifications. Hydrotreating is the most common refining technology to remove these contaminants (poisonous compounds for other processes/catalysts or to meet final fuel specifications). Vacuum gas oil is processed in a hydrocracking unit to produce gasoline and diesel or in an FCC unit to produce mainly gasoline, and LCO and HCO as by-products. The former of which is either used as a blending component in a diesel pool or fuel oil, while the latter is sent directly to the fuel oil pool.

Heavier fractions from the atmospheric and vacuum distillation units can contain asphaltenes. Asphaltenes are solid in nature and comprise polynuclear aromatics, smaller aromatics and resin molecules. The chemical structures of asphaltenes are complex and include polynuclear hydrocarbons having molecular weights up to 20,000 joined by alkyl chains. Asphaltenes also include nitrogen, sulfur, oxygen and metals, i.e., nickel, vanadium. They are present in crude oils and heavy fractions in varying quantities. Asphaltenes exist in small quantities in light crude oils, or not at all in all condensates or lighter fractions. However, they are present in relatively large quantities in heavy crude oils and petroleum fractions. Asphaltenes have been defined as the component of a heavy crude oil fraction that is precipitated by addition of a low-boiling paraffin solvent, or paraffin naphtha, such as normal pentane, and is soluble in carbon disulfide and benzene. In certain methods their concentrations are defined as the amount of asphaltenes precipitated by addition of an n-paraffin solvent to the feedstock, e.g., as prescribed in the Institute of Petroleum Method IP-143. The heavy fraction can contain asphaltenes when it is derived from carbonaceous sources such as petroleum, coal or oil shale. There is a close relationship between asphaltenes, resins and high molecular weight polycyclic hydrocarbons. Asphaltenes are hypothesized to be formed by the oxidation of natural resins. The hydrogenation of asphaltic compounds containing resins and asphaltenes produces heavy hydrocarbon oils, i.e., resins and asphaltenes are hydrogenated into polycyclic aromatic or hydroaromatic hydrocarbons. They differ from polycyclic aromatic hydrocarbons by the presence of oxygen and sulfur in varied amounts.

Upon heating above about 300-400° C., asphaltenes generally do not melt but rather decompose, forming carbon and volatile products. They react with sulfuric acid to form sulfonic acids, as might be expected on the basis of the polyaromatic structure of these components. Flocs and aggregates of asphaltenes will result from the addition of non-polar solvents, e.g., paraffinic solvents, to crude oil and other heavy hydrocarbon oil feedstocks.

Therefore, it is clear that significant measures must be taken during processing of crude oils and heavy fractions to deal with asphaltenes. Failure to do so interferes with subsequent refining operations.

There are several processing options for the vacuum residue fraction, including hydroprocessing, coking, visbreaking, gasification and solvent deasphalting.

In additional configurations, vacuum residue can be treated in an asphalt unit to produce asphalt by air oxidation. Asphalt oxidation is a process in which air is bubbled through the feedstock or pitch in an oxidizer column vessel to oxidize sulfur-containing compounds. It is a non-catalytic process to shift the sulfur molecules from the oil phase to the asphalt phase.

In some refining configurations, the vacuum residue can be processed in a solvent deasphalting unit to separate the solvent soluble (deasphalted oil) and insoluble oil (asphaltenes) fractions.

Solvent deasphalting is an asphalt separation process in which residue is separated by polarity, instead of by boiling point, as in the vacuum distillation process. The solvent deasphalting process produces a low contaminant deasphalted oil (DAO). These fractions can then be further processed in conventional conversion units such as an FCC unit or hydrocracking unit. The solvent deasphalting process is usually carried out with paraffin $C_3$-$C_7$ solvents at or below critical conditions.

Further material regarding solvent deasphalting can be found in U.S. Pat. Nos. 4,816,140; 4,810,367; 4,747,936; 4,572,781; 4,502,944:4,411,790; 4,239,616; 4,305,814; 4,290,880; 4,482,453 and 4,663,028, all of which are incorporated herein by reference.

Deasphalted oil contains a high concentration of contaminants such as sulfur, nitrogen and carbon residue which is an indicator of the coke forming properties of heavy hydrocarbons and defined as micro-carbon residue (MCR) or Conradson carbon residue (CCR) or Ramsbottom carbon residue (RCR). MCR, RCR, CCR are determined by ASTM Methods D-4530, D-524 and D-189, respectively. In these tests, the residue remaining after a specified period of evaporation and pyrolysis is expressed as a percentage of the original sample. For example, deasphalted oil obtained from vacuum residue of an Arabian crude oil contains 4.4 W % of sulfur, 2,700 ppmw of nitrogen, and 11 W % of MCR. In another example, a deasphalted oil of Far East origin contains 0.14 W % sulfur, 2,500 ppmw of nitrogen, and 5.5 W % of CCR. These high levels of contaminants, and particularly nitrogen, in the deasphalted oil limit conversion in hydrocracking or FCC units. The adverse effects of nitrogen and micro-carbon residue in FCC operations have been reported to be as follows: 0.4-0.6 W % higher coke yield, 4-6 V % less gasoline yield and 5-8 V % less conversion per 1000 ppmw of nitrogen. (See Sok Yui et al., Oil and Gas Journal, Jan. 19, 1998.) Similarly, coke yield is 0.33-0.6 W % more for each one W % of MCR in the feedstock. In hydrocracking operations, the catalyst deactivation is a function of the feedstock nitrogen and MCR content. The catalyst deactivation is about 3-5° C. per 1000 ppmw of nitrogen and 2-4° C. for each one W % of MCR.

It has been established that organic nitrogen is the most detrimental catalyst poison present in the hydrocarbon streams from the sources identified above. Organic nitrogen compounds poison the active catalytic sites resulting in catalyst deactivation, which in turn reduces catalyst cycle process length, catalyst lifetime, product yields, and product quality, and also increases the severity of operating conditions and the associated cost of plant construction and operations. Removing nitrogen, sulfur, metals and other contaminants that poison catalysts will improve refining operations and will have the advantage of permitting refiners to process more and/or heavier feedstocks.

In coking processes, heavy feeds are thermally cracked to produce coke, gas and liquid product streams of varying boiling ranges. Coke is generally treated as a low value by-product. It is removed from the units and can be recovered for various uses depending on its quality.

The use of heavy crude oils having high metals and sulfur content as an initial feed is of interest due to its lower market value. Traditional coking processes using these feeds produce coke which has substantial sulfur and metal content. The goal of minimizing air pollution is a further incentive for treating residuum in a coking unit since the gases and liquids produced contain sulfur in a form that can be relatively easily removed.

While individual and discrete asphalt oxidation, solvent deasphalting and coking operations processes are well developed and suitable for their intended purposes, there remains a need in the art for more economical and efficient processes for obtaining product from heavy feeds such as atmospheric and/or vacuum residues containing asphaltenes, N, S and metal contaminants.

SUMMARY OF THE INVENTION

An integrated system and process is provided for producing asphalt, high quality petroleum green coke, and liquid and gas coking unit products.

In one embodiment, the integrated process includes charging a heavy feedstock to an oxidizing unit along with an effective quantity of oxidant to produce an intermediate charge containing oxidized organosulfur compounds. The intermediate charge is passed to a solvent deasphalting unit along with an effective quantity of solvent to produce a deasphalted/desulfurized oil phase and an asphalt phase containing oxidized organosulfur compounds. The deasphalted/desulfurized oil phase is passed to a coker unit including a coker furnace and at least one coker drum to produce liquid and gas coker products as an effluent stream and to recover petroleum green coke from the coker drum.

In certain embodiments of the integrated process, which can be carried out within refinery limits, use of the deasphalted/desulfurized oil intermediate stream as feed to the coking unit enables recovery of high quality petroleum coke that can be used as raw material to produce low sulfur marketable grades of coke including anode grade coke (sponge) and/or electrode grade coke (needle).

BRIEF DESCRIPTION OF THE DRAWINGS

The invention will be described in further detail below and with reference to the attached drawing where:

FIG. 1 is a process flow diagram of an integrated process for asphalt oxidation, solvent deasphalting and delayed coking.

DETAILED DESCRIPTION OF THE INVENTION

An integrated process is provided to produce asphalt, petroleum green coke, and liquid and gas coking unit products. In the process described herein, sulfur molecules, and in certain embodiments nitrogen molecules, that are present in heavy petroleum fractions (e.g., in atmospheric residue) are oxidized. The polar oxidized sulfur compounds and in certain embodiments oxidized nitrogen compounds which are generally insoluble in the solvent used in the process generally shift from the soluble oil phase to the insoluble asphalt phase. Advantageously, the present process and system can be integrated with solvent deasphalting units of existing refineries to remove impurities at comparatively lower cost.

The deasphalted/desulfurized oil is thermally cracked in a coking unit, such as a delayed coking unit. In contrast to typical coking operations in which the coke is low market value by-product, in the integrated process herein, using as an initial feed heavy crude oils or fractions having reduced asphaltenes, metal and sulfur content, high quality petroleum green coke recovered from the coker unit drums is low in sulfur and metals. The recovered high quality petroleum green coke can be used as high quality, low sulfur and metal content fuel grade (shot) coke, and/or a raw material for production of low sulfur and metal content marketable grades of coke including anode grade coke (sponge) and/or electrode grade coke (needle). Table 5 shows the properties of these types of coke. In accordance with certain embodiments of the process herein, calcination of the petroleum green coke recovered from the coking drums produces sponge and/or needle grade coke, e.g., suitable for use in the aluminum and steel industries. Calcination occurs by thermal treatment to remove moisture and reduce the volatile combustible matter.

TABLE 5

| Property | Units | Fuel Coke | Calcined Sponge Coke | Calcined Needle Coke |
|---|---|---|---|---|
| Bulk Density | $Kg/m^3$ | 880 | 720-800 | 670-720 |
| Sulfur | W % (max) | 3.5-7.5 | 1.0-3.5 | 0.2-0.5 |
| Nitrogen | ppmw (max) | 6,000 | — | 50 |
| Nickel | ppmw (max) | 500 | 200 | 7 |
| Vanadium | ppmw | 150 | 350 | — |
| Volatile Combustible Material | W % (max) | 12 | 0.5 | 0.5 |
| Ash Content | W % (max) | 0.35 | 0.40 | 0.1 |
| Moisture Content | W % (max) | 8-12 | 0.3 | 0.1 |
| Hardgrove Grindability Index (HGI) | W % | 35-70 | 60-100 | — |
| Coefficient of thermal expansion, E + 7 | ° C. | — | — | 1-5 |

As used herein, "high quality petroleum green coke" refers to petroleum green coke recovered from a coker unit that when calcined, possesses the properties as in Table 5, and in certain embodiments possessing the properties in Table 5 concerning calcined sponge coke or calcined needle coke identified in Table 5.

As used herein, a process that operates "within the battery limits of a refinery" refers to a process that operates with a battery of unit operations along with their related utilities and services, distinguished from a process whereby effluent from a unit operation is collected, stored and/or transported to a separate unit operations or battery of unit operations.

In one embodiment of a process herein, which can be carried out within the battery limits of a refinery and on a continuous or semi-continuous basis, a heavy feed such as an atmospheric residue fraction, e.g., boiling 370° C. and above, is passed to an asphalt unit for air oxidation to promote desulfurization and/or denitrification, in the presence or absence of catalysts. The asphalt unit product is introduced to a solvent deasphalting unit to separate oil fractions containing a reduced content of organosulfur compounds, and in certain embodiments also a reduced content of organonitrogen compounds, from the asphalt product, as the oil phase is relatively lighter than the asphalt phase. The deasphalted/desulfurized oil is thermally cracked in a coking unit, such as a delayed coking unit, and coker liquid and gas products are recovered, along with high quality petroleum green coke.

The process includes the steps of:

Providing a hydrocarbon feedstock boiling in the range 36-1500° C., in certain embodiments above about 370° C. and in further embodiments above about 520° C., which contains impurities including sulfur, nitrogen nickel, vanadium, iron and molybdenum compounds, typically from crude oil sources;

Optionally adding the homogeneous catalysts to the feedstock. Homogeneous transition metal catalysts, active species of which are Mo(VI), W(VI), V(V), Ti(IV), possessing high Lewis acidity with weak oxidation potential are used as catalysts;

Mixing oxidant with the feedstock at the inlet of an asphalt oxidation unit. In certain embodiments the oxidant can be a gaseous oxidant such as air or oxygen or nitrous oxide or ozone. In other embodiments, the oxidant can include organic peroxides or aqueous peroxides such as hydrogen peroxide. Organic peroxides can be organic hydroperoxides such as alkyl hydroperoxides or aryl hydroperoxides, dialkyl peroxides, diaryl peroxides, or a combination comprising at least one of the foregoing organic peroxides. The dialkyl and diaryl peroxides have the general formula R1-O—O—R2, wherein R1 and R2 are the same or different alkyl groups or aryl groups. The available oxygen to oil ratio is in the range 1-50 V:V %, in certain embodiments 3-20 V:V % or equivalent for gaseous oxidants other than oxygen. The asphalt unit operates at a temperature of 100-300° C. and in certain embodiments 150-200° C. at the inlet and 150-400° C. and in certain embodiments 250-300° C. in the oxidation zone, and at a pressure level ranging from ambient to 60 bars and in certain embodiments from ambient to 30 bars;

Mixing the asphalt reactor effluents in a vessel with a $C_3$ to $C_7$-paraffinic solvent, in certain embodiments a mixture of $C_4$-normal and iso-butane, at a temperature and a pressure that are below the solvent's critical pressure and temperature, to thereby disturb the equilibrium of the asphaltenes in maltenes solution and to flocculate the solid asphaltenes particles. The critical temperatures and pressures for the paraffinic solvents are given in Table 6, and other solvent properties are given in Table 7;

Optionally using adsorbents in the solvent deasphalting stage to selectively further separate the nitrogen, sulfur and poly-aromatic compounds, for instance, as described in U.S. Pat. No. 7,566,634 which is incorporated by reference herein;

Separating solid phase asphaltenes from the liquid phase in a first separator vessel and transferring the bottoms to asphalt pool and the upper liquid layer to a second separation vessel;

Separating the deasphalted/desulfurized oil in the second separation vessel and recovering the paraffinic solvent for recycling to the mixing vessel; and Introducing the deasphalted/desulfurized oil to a delayed coker unit to produce high quality petroleum green coke, and liquid and gas coking unit products.

TABLE 6

| Carbon Number | Critical Temperature, ° C. | Critical Pressure, bar |
|---|---|---|
| $C_3$ | 97 | 42.5 |
| $C_4$ | 152 | 38.0 |
| $C_5$ | 197 | 34.0 |
| $C_6$ | 235 | 30.0 |
| $C_7$ | 267 | 27.5 |

TABLE 7

| Name | Formula | MW g/g-mol | Boiling Point ° C. | Specific Gravity | Critical Temperature ° C. | Critical Pressure bar |
|---|---|---|---|---|---|---|
| propane | $C_3H_8$ | 44.1 | −42.1 | 0.508 | 96.8 | 42.5 |
| n-butane | $C_4H_{10}$ | 58.1 | −0.5 | 0.585 | 152.1 | 37.9 |
| i-butane | $C_4H_{10}$ | 58.1 | −11.7 | 0.563 | 135.0 | 36.5 |
| n-pentane | $C_5H_{12}$ | 72.2 | 36.1 | 0.631 | 196.7 | 33.8 |
| i-pentane | $C_5H_{12}$ | 72.2 | 27.9 | 0.625 | 187.3 | 33.8 |

Referring to FIG. 1, a process flow diagram of an integrated apparatus 8 for the production of asphalt and desulfurized oil is provided. Integrated apparatus 8 includes an oxidizing unit 10 (such as an oxidizer column vessel) and a solvent deasphalting unit 18 including a first separation vessel 20, a second separation vessel 30, a deasphalted/desulfurized oil separator 40, a solvent steam stripping vessel 50, an asphalt separation vessel 60, an asphalt stripper vessel 70, a recycle solvent vessel 80 and a delayed coking unit 90.

Oxidizing unit 10 can be any suitable oxidation apparatus effective for converting organosulfur compounds and in certain embodiments organonitrogen compounds in a residual oil feedstock 12 into oxides thereof that are insoluble in the deasphalting unit solvent. In certain embodiments oxidizing unit 10 can be an oxidizer column vessel including an inlet 15 for receiving a residual oil feedstock 12 (downstream of one or more heat exchangers, not shown) and optionally catalyst 14, an inlet 16 for receiving blanketing steam, an oxidant inlet 11, and an oxidized residual oil outlet 22.

Solvent deasphalting unit 18 includes a first separation vessel 20, e.g., a primary settler, includes an inlet 24 in fluid communication with outlet 22 of the oxidizer column vessel 10, an outlet 28 for discharging an asphalt phase, and an outlet 32 for discharging a deasphalted/desulfurized oil phase. A make-up solvent stream 26, a recycled solvent stream 62 and a second separation vessel bottoms stream 78 are also charged to the first separation vessel 20 via an optional mixing vessel 25.

Second separation vessel 30, e.g., a secondary settler, includes an inlet 34 in fluid communication with deasphalted/desulfurized oil 32 of the first settler vessel 20, an outlet 36 for discharging a deasphalted/desulfurized oil phase and an outlet 38 for discharging an asphalt phase.

Deasphalted/desulfurized oil separator 40 is typically a flash separator for solvent recovery and includes an inlet 42 in fluid communication with tops outlet 36 of the second separation vessel 30, an outlet 46 for discharging deasphalted/desulfurized oil separator bottoms, and an outlet 44 for discharging recycled solvent.

Solvent steam stripping vessel 50 includes an inlet 48 in fluid communication with outlet 46 of the deasphalted/desulfurized oil separator 40, an outlet 52 for discharging steam and excess solvent and an outlet 54 for discharging a deasphalted/desulfurized oil stream.

Outlet 54 is in fluid communication with a coking unit 90, which in certain embodiments is a delayed coker unit including a coking furnace 91, two or more parallel drums 92*a* and 92*b*, and a coking product fractionator 95.

Asphalt separation vessel 60 includes an inlet 64 in fluid communication with the asphalt phase outlet 28 of the first separation vessel 20, an outlet 68 for discharging asphalt separation vessel bottoms, and an outlet 66 for discharging recycled solvent to recycle solvent vessel 80.

Asphalt stripper vessel 70 includes an inlet 72 in fluid communication with bottoms outlet 68 of the asphalt separation vessel 60, an outlet 76 for discharging solvent and an outlet 74 for discharging asphalt product.

Recycle solvent vessel 80 includes an inlet 56 in fluid communication with tops outlet 44 of the deasphalted/desulfurized oil separator 40 and a conduit 84 which is in fluid communication with outlet 66 of asphalt separation vessel 60. Outlet 58 of recycle solvent vessel 80 is in fluid communication with conduit 62 for admixing with the feed.

A residual oil feedstock is introduced into inlet 12 of the oxidizer column vessel 10 after passage through one or more heat exchangers (not shown). In certain embodiments, a homogeneous catalyst can be introduced via conduit 14. Blanketing steam is continuously injected into the oxidizer column vessel 10 via inlet 16. Residual oil feedstock is oxidized and discharged via outlet 22. In embodiments in which gaseous oxidant is used, after compression (for which the compressors are not shown) the gas is passed to a knockout drum (not shown) and is routed to distributors, e.g., above the bottom of the oxidizer column.

Gaseous oxidant that can be effectively used in the process includes air or oxygen or nitrous oxide or ozone. The oxygen to oil ratio is in the range 1-50 V:V %, preferably 3-20 V:V % or equivalent for other gaseous oxidants. The oxidizing unit operates at a temperature of 150-200° C. at the inlet and 250-300° C. in the oxidation zone, and at a pressure level ranging from ambient to 30 bars.

Asphalt oxidation serves to increase the molecular size of the asphaltene components by adding oxygen atoms to the heavy hydrocarbon molecules. This results in an asphalt product that is thicker and denser (60-70 mm penetration) than the vacuum column bottoms pitch feedstock (230-250 mm penetration). In the present process a feed such as an atmospheric residue is used to selectively oxidize the sulfur- and nitrogen-containing organic compounds to shift them to the asphalt phase. Accordingly, the primary objective of the integrated asphalt oxidation and solvent deasphalting unit is to produce desulfurized oil, and asphalt is produced as a by-product.

Oxidized residual oil feedstock from outlet 22 of the oxidizer column vessel 10 is mixed with make-up solvent 26 and recycled solvent 62, e.g., via one or more in-line mixers (not-shown) or the optional mixing vessel 25.

The asphalt oxidation reactor effluents are mixed with a $C_3$ to $C_7$-paraffinic solvent, in certain embodiments a mixture of $C_4$-normal and iso-butane, at a temperature and a pressure that are below the solvent's critical pressure and temperature, to thereby disturb the equilibrium of the asphaltenes in maltenes solution and to flocculate the solid asphaltenes particles. The critical temperatures and pressures for the paraffinic solvents are given in Table 5, and other solvent properties are given in Table 6. The admixing can occur in one or more mixing vessels and/or via one or more in-line mixers.

Optionally, adsorbents are used in the solvent deasphalting stage to selectively further separate the nitrogen, sulfur and poly-aromatic compounds, for instance, as described in U.S. Pat. No. 7,566,634 which is incorporated by reference herein.

The mixture is passed to inlet 24 of the first separation vessel 20, e.g., a primary settler of a solvent deasphalting unit, in which it is phase separated into a deasphalted/desulfurized oil phase discharged via outlet 32 and an asphalt phase discharged via outlet 28. The oxidized portion of the residual oil feedstock has a polarity that results in shifting to the asphalt phase due to its insoluble nature in the solvent. The pressure and temperature of the primary settler are at or below the critical properties of the solvent. The temperature of the primary settler is low in order to recover a majority of deasphalted/desulfurized oil from the oxidized residual oil charge. The solvent-soluble deasphalted/desulfurized oil phase which is collected from the primary settler, e.g., via a collector pipe, includes of a major proportion of solvent and deasphalted/desulfurized oil, and a minor proportion of asphalt. The solvent-insoluble asphalt phase which is recovered, e.g., via one or more asphalt collector pipes, includes a major proportion of asphalt, and a minor proportion of solvent, oil phase and oxidized organosulfur compounds (and in certain embodiments oxidized organonitrogen compounds).

Deasphalted/desulfurized oil is passed to inlet 34 of the second separation vessel 30, e.g., a secondary settler of a solvent deasphalting unit, to be separated into a deasphalted/desulfurized oil phase discharged via outlet 36 (e.g., a vertical collector pipe) and an asphalt phase via outlet 38 (e.g., one or more asphalt collector pipes). The remaining asphalt mixture containing oxidized organosulfur compounds (and in certain embodiments oxidized organonitrogen compounds) is rejected as asphalt phase in the secondary settler vessel 30 due to increased temperature relative to the operating temperature of the primary settler. The secondary settler is typically operated at temperatures at or approaching the critical temperature of the solvent, and enables formation of an asphalt phase at the bottom which contains relatively minor amount of solvent and deasphalted oil which is recycled back to the primary settler vessel 20. The deasphalted/desulfurized oil phase discharged via outlet 38 includes a major proportion of solvent and deasphalted/desulfurized oil and is recycled to the primary settler vessel 20 via conduit 78 for recovery of desulfurized oil.

The deasphalted/desulfurized oil phase from the second separation vessel outlet 36 is passed to inlet 42 of separator 40 to be separated into a deasphalted/desulfurized oil product stream 46 and solvent recycle stream 44. Recycled solvent via outlet 44 is passed to recycle solvent vessel 80 and returned to the primary settler vessel 20, e.g., via mixing vessel 90. The deasphalted/desulfurized oil separator 40 is configured and dimensioned to permit a rapid and efficient flash separation.

Deasphalted/desulfurized oil product stream 46 including a major proportion of deasphalted/desulfurized oil and a minor proportion of solvent and steam is conveyed to inlet 48 of vessel 50 for steam stripping of the solvent, e.g., with 150 psig of dry steam. The deasphalted/desulfurized oil is recovered via outlet 54, and a mixture of steam and excess solvent is discharged via outlet 52.

The deasphalted/desulfurized oil stream from outlet 54 is charged to a coking unit 90. In certain embodiments, coking unit 90 is a delayed coker unit, in which the deasphalted/desulfurized oil stream is charged to a coking furnace 91 where the contents are rapidly heated to a coking temperature in the range of 480° to 530° C. and then fed to a coking drum 92*a* or 92*b*. Coking unit 90 can be configured with two or more parallel drums 92*a* and 92*b* and can be operated in a swing mode, such that when one of the drums is filled with coke, the deasphalted/desulfurized oil stream is transferred to the empty parallel drum and recover coke, in certain embodiments high quality petroleum green coke. Accordingly, an integrated and continuous or semi-continuous process is provided to produce asphalt, high quality petroleum green coke, and liquid and gas coking unit products.

Liquid and gas stream 94 from the coker drum 92*a* or 92*b* are fed to a coking product fractionator 95. Any hydrocarbon vapors remaining in the coke drum are removed by steam injection. The coke is cooled with water and then removed from the coke drum using hydraulic and/or mechanical means. In certain embodiments according to the system and process herein, this recovered coke is fuel grade coke or anode grade coke.

Liquid and gas coking unit product stream 94 is introduced into a coking product stream fractionator 95. The coking product stream 94 is fractionated to yield separate product streams that can include a light gas stream 96, a coker naphtha stream 97, a light coker gas oil stream 68 and a heavy coker gas oil stream 99, each of which are recovered from the fractionator.

Advantageously, the integrated process facilities production of marketable coke since the feed thereto, the deasphalted/desulfurized oil stream, has desirable qualities. In particular, the deasphalted/desulfurized oil stream from outlet 54 in the present process is characterized by a sulfur content of generally less than about 15 wt %, in certain embodiments less than about 2.5 wt % and in further embodiments less than about 1 wt %, and a metals content of less than about 700 ppmw, in certain embodiments less than about 400 ppmw and in further embodiments less than about 100 ppmw. Use of this feedstream results in a high quality petroleum coke product that can be used as raw material to produce low sulfur marketable grades of coke including anode grade coke (sponge) and/or electrode grade coke (needle), in an efficient integrated process.

The primary settler asphalt phase via outlet 28 is passed to inlet 64 of the asphalt separation vessel 60 for flash separation into an asphalt phase discharged via outlet 68 and recycled solvent discharged via outlet 66. The asphalt phase 68 including a major proportion of asphalt and a minor proportion of solvent is conveyed to inlet 72 of the asphalt stripper vessel 70 for steam stripping of the solvent, e.g., with 150 psig of dry steam. Solvent is recovered via outlet 76 (which can be recycled, not shown) and an asphalt product containing oxidized organosulfur compounds (and in certain embodiments oxidized organonitrogen compounds) is recovered via outlet 74, which can be sent to an asphalt pool.

Coking is a carbon rejection process in which low-value atmospheric or vacuum distillation bottoms are converted to lighter products which in turn can be hydrotreated to produce transportation fuels, such as gasoline and diesel. Conventionally, coking of residuum from heavy high sulfur, or sour, crude oils is carried out primarily as a means of utilizing such low value hydrocarbon streams by converting part of the material to more valuable liquid and gas products. Typical coking processes include delayed coking and fluid coking.

In the delayed coking process, feedstock is typically introduced into a lower portion of a coking feed fractionator where one or more lighter materials are recovered as one or more top fractions, and bottoms are passed to a coking furnace. In the furnace bottoms from the fractionator and optionally heavy recycle material are mixed and rapidly heated in a coking furnace to a coking temperature, e.g., in the range of 480° C. to 530° C., and then fed to a coking drum. The hot mixed fresh and recycle feedstream is maintained in the coke drum at coking conditions of temperature and pressure where the feed decomposes or cracks to form coke and volatile components.

Table 8 provides delayed coker operating conditions for production of certain grades of petroleum green coke in the process herein:

TABLE 8

| Variable | Unit | Fuel Coke | Sponge Coke | Needle Coke |
|---|---|---|---|---|
| Temperature | ° C. | 488-500 | 496-510 | 496-510 |
| Pressure | $Kg/cm^2$ | 1 | 1.2-4.1 | 3.4-6.2 |
| Recycle Ratio | % | 0-5 | 0-50 | 60-120 |
| Coking time | hours | 9-18 | 24 | 36 |

The volatile components are recovered as vapor and transferred to a coking product fractionator. One or more heavy fractions of the coke drum vapors can be condensed, e.g., quenching or heat exchange, in certain embodiments the contact the coke drum vapors are contacted with heavy gas oil in the coking unit product fractionator, and heavy fractions form all or part of a recycle oil stream having condensed coking unit product vapors and heavy gas oil. In certain embodiments, heavy gas oil from the coking feed fractionator is added to the flash zone of the fractionator to condense the heaviest components from the coking unit product vapors.

Coking units are typically configured with two parallel drums and operated in a swing mode. When the coke drum is full of coke, the feed is switched to another drum, and the full drum is cooled. Liquid and gas streams from the coke drum are passed to a coking product fractionator for recovery. Any hydrocarbon vapors remaining in the coke drum are removed by steam injection. The coke remaining in the drum is typically cooled with water and then removed from the coke drum by conventional methods, e.g., using hydraulic and/or mechanical techniques to remove green coke from the drum walls for recovery.

Recovered petroleum green coke is suitable for production of marketable coke, and in particular anode (sponge) grade coke effective for use in the aluminum industry, or electrode (needle) grade coke effective for use in the steel industry. In the delayed coking production of high quality petroleum green coke, unconverted pitch and volatile combustible matter content of the green coke intermediate product subjected to calcination should be no more than about 15 percent by weight, and preferably in the range of 6 to 12 percent by weight.

In certain embodiments, one or more catalysts and additives can be added to the fresh feed and/or the fresh and recycle oil mixture prior to heating the feedstream in the coking unit furnace. The catalyst can promote cracking of the heavy hydrocarbon compounds and promote formation of the more valuable liquids that can be subjected to hydrotreating processes downstream to form transportation fuels. The catalyst and any additive(s) remain in the coking unit drum with the coke if they are solids, or are present on a solid carrier. If the catalyst(s) and/or additive(s) are soluble in the oil, they are carried with the vapors and remain in the liquid products. Note that in the production of high quality petroleum green coke, catalyst(s) and/or additive(s) which are soluble in the oil can be favored in certain embodiments to minimize contamination of the coke.

Recycled solvent from outlet 66 of the asphalt separation vessel 60 is passed to recycle solvent vessel 80 via conduit 84 along with recycled solvent 44 from second separation vessel 40. Recycled solvent is conveyed via outlet 58 as needed for mixing with the oxidized residual oil feedstock from outlet 22, e.g., in mixing vessel 90 and/or in one or more in-line mixers. One or more intermediate solvent drums can be incorporated as required.

In the primary settler 20, the deasphalted oil phase includes a majority of solvent and the deasphalted oil with a minor amount of asphalt discharged from the top of the primary settler (outlet 32). The asphalt phase which contains 40-50 liquid V % solvent leaves the bottom of the vessel (outlet 28). In the secondary settler 30, the deasphalted oil phase from the primary settler 20 which contains some asphalt enters the vessel. The rejected asphalt from the secondary settler contains a relatively small amount of solvent and deasphalted oil. In the deasphalted/desulfurized oil separator 40, greater than 90 W % of the solvent charged to the settler enter the deasphalted/desulfurized oil separator where more than 95 W % of that is recovered. Deasphalted/desulfurized oil from the deasphalted/desulfurized oil separator, which contains trace amount of solvent enters the deasphalted oil stripper 50. Essentially all solvent is removed from the deasphalted oil by steam stripping. The asphalt separator 60 permits flash separation of the asphalt and the solvent. The asphalt phase contains 40-50 V % of solvent. Asphalt from the asphalt separator enters the asphalt stripper 70, where the residual solvent is removed from the asphalt by steam stripping. Approximately 95 W % of circulating solvent which is recovered in high pressure system and the balance of circulating solvent which is recovered in the low pressure system join together and enter the high pressure solvent drum 80.

The feedstock is generally atmospheric residue boiling above 370° C. In certain embodiments the feedstock can be whole crude oil with one or more separation steps upstream of the initial feed 12. A feedstock can be derived from one or more naturally occurring sources such as crude oils, bitumens, heavy oils, or shale oils, and/or bottoms from one or more refinery process units including hydrotreating, hydroprocessing, fluid catalytic cracking, coking, and visbreaking or coal liquefaction.

In one or more embodiments, a second feed can optionally be introduced with the mixture at inlet 24. In one or more embodiments, certain intermediate oil or asphalt streams can be recycled to the oxidizing unit 10.

Advantageously, by integrating asphalt oxidation, solvent deasphalting and delayed coking, atmospheric residual oil or vacuum residual oil is desulfurized with existing units to obtain asphalt, high quality petroleum green coke effective as raw material to produce marketable coke, and liquid and gas coker products at lower cost than conventional high-pressure desulfurization process. For instance, atmospheric residue can be desulfurized so that, in certain embodiments, 40 W % of desulfurized oil is recovered, with the remaining portion passing into the asphalt phase, which is also valuable product. This 40 W % of desulfurized oil can then advantageously be used to produce gas and liquid coker products, and marketable coke.

Sulfur molecules contained in heavy petroleum fractions, including organosulfur molecules, and in certain embodiments organonitrogen molecules in heavy petroleum fractions are oxidized. The polar oxidized sulfur compounds shift from the oil phase to the asphalt phase. Advantageously, the present process and system can be integrated with existing solvent deasphalting units to remove impurities at comparatively lower cost, and with existing coking units to process the desulfurized oil to produce marketable coke and coker gas and liquid products.

While individual and discrete asphalt oxidation, solvent deasphalting and coking processes are well developed, it has not previously been suggested to integrate these processes to desulfurize atmospheric residual oil feedstock by oxidation and purify the oxidized feedstocks by solvent deasphalting process to produce desulfurized oil and asphalt products, and further integrate a coking unit, such as a delayed coking unit, to produce high quality petroleum green coke, and liquid and gas coking unit products.

Example 1

An atmospheric residue from Arab Light crude oil referenced with initial and final boiling points of 154° C. and 739° C. respectively was desulfurized in a oxidation vessel. The properties of feedstock oil are shown in Table 9.

In the oxidation reactions, polyoxoanions obtained by combining sodium tungsten $Na_2WO_4$, $2H_2O$ with acetic acid are used as a catalytic system. A 30% $H_2O_2/H_2O$ solution is used as an oxidizing agent. The amount of the $H_2O_2$ solution was selected so that the molar ratio of $H_2O_2$ to s is about 5. The oxidation reactions were carried out in is glass reactor stirred with a magnetic stirrer plate at 70° C. and 1 atm for 1.5 hour were done separately. After that the reaction medium is cooled down to room temperature. The properties, after separation of aqueous phase are given in Table 10.

TABLE 9

| Property | Atmospheric Residue |
|---|---|
| Sulfur, W % | 3.34 |
| Nitrogen, ppmw | 3.34 |
| Density, Kg/Lt | 0.9642 |
| Distillation, ASTM D2887 | ° C. |
| IBP | 154 |
| 5 W % | 282 |
| 10 W % | 328 |
| 20 W % | 372 |
| 30 W % | 408 |
| 40 W % | 444 |
| 50 W % | 482 |
| 70 W % | 567 |
| 90 W % | 672 |
| 95 W % | 708 |
| FBP | 739 |

In two separate experiments, atmospheric residue and oxidized atmospheric residue feedstocks were sent to solvent deasphalting unit to separate the asphalt and deasphalted oil. Table 10 summarizes the yields and sulfur content of the fractions of the atmospheric residues. The sulfur content of the deasphalted oil is reduced from 1.98 W to 1.2 W % but at a cost of yield, about 7.5 W %

TABLE 10

| | Before Oxidation | | After Oxidation | |
|---|---|---|---|---|
| | W % | S, W % | W % | S, W % |
| DAO | 67.9 | 1.2 | 60.6 | 1.2 |
| Asphalt | 32.1 | 6.3 | 39.4 | 6.7 |
| Total | 100.1 | 3.4 | 100 | 3.4 |

The desulfurized deasphalted oil is then sent to a delayed coking unit to produce high quality petroleum green coke. The process produced 14.3 W % petroleum green coke containing 2.5 W % sulfur, within the acceptable limits for use as raw material to produce anode grade (calcined sponge) coke, as set forth in Table 5 herein. Detailed delayed coking product yields are given in Table 11.

TABLE 11

| Product | Yield, W % |
|---|---|
| Coke | 14.3 |
| Gas | 9.1 |
| Naphtha | 14.4 |
| Gas Oil | 36.0 |
| Heavy Gas Oil | 26.2 |
| | 100.0 |

Example 2

Petroleum green coke recovered from a delayed coker unit is subjected to calcination. In particular, samples of about 3 kg of Petroleum green coke were calcined according to the following heat-up program: Room Temperature to 200° C. at 200° C./h heating rate; 200° C. to 800° C. at 30°

C./h heating rate; 800° C. to 1100° C. at 50° C./h heating rate; Soaking Time at 1,100° C.: 20 h.

Table 12 shows the properties of the samples of petroleum green coke and Table 13 shows the properties of the calcium samples.

TABLE 12

| Property | Method | Unit | Range | Sample 1 | Sample 2 |
|---|---|---|---|---|---|
| Water Content | ISO 11412 | % | 6.0-15.0 | 0.0 | 0.0 |
| Volatile Matter | ISO 9406 | % | 8.0-12.0 | 4.8 | 5.9 |
| Hardgrove Grindability Index | ISO 5074 | — | 60-100 | 41 | 50 |
| Sieving Analysis | ISO 12984 | % | | | |
| >32 mm | | | 10.0-20.0 | 0.0 | 0.0 |
| >16 mm | | | 20.0-40.0 | 0.0 | 0.0 |
| 16-8 mm | | | 10.0-20.0 | 37.1 | 17.2 |
| 8-4 mm | | | 10.0-20.0 | 23.5 | 18.2 |
| 4-2 mm | | | 10.0-20.0 | 15.2 | 14.4 |
| 2-1 mm | | | 10.0-20.0 | 11.9 | 16.1 |
| 1-0.5 mm | | | 5.0-15.0 | 7.0 | 12.2 |
| 0.50-0.25 mm | | | 5.0-15.0 | 3.6 | 8.5 |
| <0.25 mm | | | 5.0-15.0 | 1.7 | 13.3 |
| XRF Analysis | ISO 12980 | %/ppm | | | |
| S | | | 0.50-4.00 | 3.40 | 3.36 |
| V | | | 50-350 | 83 | 76 |
| Ni | | | 50-220 | 80 | 77 |
| Si | | | 20-250 | 71 | 45 |
| Fe | | | 50-400 | 92 | 154 |
| Al | | | 50-250 | 71 | 45 |
| Na | | | 20-120 | 44 | 27 |
| Ca | | | 20-120 | 18 | 13 |
| P | | | 1-20 | 2 | 1 |
| K | | | 5-15 | 0 | 0 |
| Mg | | | 10-30 | 13 | 11 |
| Pb | | | 1-5 | 0 | 0 |
| Ash Content | ISO 8005 | % | 0.10-0.30 | 0.08 | 0.08 |

TABLE 13

| Property | Method | Unit | Range | Sample 1 | Sample 2 |
|---|---|---|---|---|---|
| Water Content | ISO 11412 | % | 0.0-0.2 | 0.0 | 0.0 |
| Volatile Matter | ISO 9406 | % | 0.0-0.5 | 0.3 | 0.5 |
| Hardgrove Grindability Index | ISO 5074 | — | — | 41 | 49 |
| Sieving Analysis | ISO 12984 | % | | | |
| >32 mm | | | 0.0-5.0 | 0.0 | 0.0 |
| >16 mm | | | 0.0-15.0 | 0.0 | 0.0 |
| 16-8 mm | | | 10.0-20.0 | 27.4 | 11.9 |
| 8-4 mm | | | 10.0-20.0 | 31.4 | 19.7 |
| 4-2 mm | | | 15.0-25.0 | 14.5 | 13.4 |
| 2-1 mm | | | 10.0-20.0 | 12.2 | 16.8 |
| 1-0.5 mm | | | 5.0-15.0 | 7.7 | 14.1 |
| 0.50-0.25 mm | | | 5.0-15.0 | 4.4 | 9.9 |
| <0.25 mm | | | 5.0-10.0 | 2.5 | 14.1 |
| XRF Analysis | ISO 12980 | %/ppm | | | |
| S | | | 0.50-3.50 | 3.13 | 3.01 |
| V | | | 50-400 | 89 | 84 |
| Ni | | | 50-250 | 98 | 89 |
| Si | | | 50-300 | 8 | 19 |
| Fe | | | 50-450 | 165 | 189 |
| Al | | | 50-250 | 10 | 11 |
| Na | | | 30-140 | 18 | 16 |
| Ca | | | 30-140 | 9 | 7 |
| P | | | 1-20 | 1 | 2 |
| K | | | 5-15 | 0 | 0 |
| Mg | | | 10-30 | 5 | 18 |
| Pb | | | 1-5 | 0 | 0 |
| Ash Content | ISO 8005 | % | 0.10-0.30 | 0.04 | 0.07 |
| Pulverizing Factor | M168 | — | 1.05-1.25 | 1.15 | 1.41 |

TABLE 13-continued

| Property | Method | Unit | Range | Sample 1 | Sample 2 |
|---|---|---|---|---|---|
| Real Density in Xylene | ISO 8004 | $kg/dm^3$ | 2.05-2.10 | 2.102 | 2.092 |
| Crystallite Size Lc | ISO 20203 | Å | 25.0-32.0 | 29.6 | 28.2 |
| Resiflex | ISO 10143 | μΩm | 460-540 | 397 | 400 |
| Specific Electrical Resistance | | $kg/dm^3$ | 0.85-0.92 | 0.92 | 0.94 |
| Pressed Density (1.4-1.0 mm) | | | | | |
| Air Reactivity 525° C. | ISO 12982-1 | %/min | 0.05-0.30 | 0.06 | 0.07 |
| CO2 Reactivity | ISO 12981-1 | % | 3.0-15.0 | 1.6 | 1.9 |

The method and system of the present invention, have been described above and in the attached drawing; however, modifications will be apparent to those of ordinary skill in the art and the scope of protection for the invention is to be defined by the claims that follow.

The invention claimed is:

1. An integrated process that operates within the battery limits of a refinery producing asphalt, coker oil and gas products, and petroleum green coke, the process comprising:

charging a feedstock to an oxidizing unit along with an effective quantity of oxidant to produce an intermediate charge containing oxidized organosulfur compounds;

passing the intermediate charge to a solvent deasphalting unit along with an effective quantity of solvent to produce a deasphalted/desulfurized oil phase and an asphalt phase containing oxidized organosulfur compounds; and passing the deasphalted/desulfurized oil phase to a coker unit including a coker furnace and at least one coker drum to produce liquid and gas coker products as an effluent stream and recover petroleum green coke from the coker drum.

2. The process of claim 1 wherein the coker unit is a delayed coker unit.

3. The process of claim 2, wherein the coker unit is configured with two or more parallel drums and is operated in a swing mode, and wherein the process is continuous.

4. The process of claim 1 wherein the deasphalted/desulfurized oil phase contains less than 2.5 W % sulfur.

5. The process of claim 4, wherein the deasphalted/desulfurized oil phase contains less than 700 ppmw metal.

6. The process of claim 5, wherein the petroleum green coke recovered from the coker drum effective raw material for calcination into anode grade coke (sponge) or electrode grade coke (needle).

7. The process as in claim 1 in which the oxidizing unit is an asphalt oxidizer.

8. The process as in claim 1 wherein the intermediate charge contains oxidized organosulfur compounds and oxidized organonitrogen compounds.

9. The process as in claim 8 wherein the oxidized organosulfur compounds and oxidized organonitrogen compounds are insoluble in the solvent used in the solvent deasphalting unit and thereby shift to the asphalt phase.

10. The process as in claim 1 wherein the oxidizing unit is operated at an inlet temperature in the range of from 100-300° C.

11. The process as in claim 1 wherein the oxidizing unit is operated at an inlet temperature in the range of from 150-200° C.

12. The process as in claim 1 wherein the oxidizing unit is operated at a temperature in the range of from 150-400° C.

13. The process as in claim 1 wherein the oxidizing unit is operated at a temperature in the range of from 250-300° C.

14. The process as in claim 1 wherein the oxidizing unit is operated at a pressure in the range of from ambient to 60 bars.

15. The process as in claim 1 wherein the oxidizing unit is operated at a pressure in the range of from ambient to 30 bars.

16. The process as in claim 1, wherein the solvent is a $C_3$ to $C_7$-paraffinic solvent.

17. The process as in claim 16, wherein the solvent deasphalting unit operates at a temperature and a pressure that are below critical pressure and temperature levels of the solvent.

18. The process as in claim 17, wherein the solvent is a mixture of $C_4$-normal and iso-butane.

19. The process as in claim 16, wherein operations in the solvent deasphalting unit include mixing the intermediate charge and solvent with recycle solvent and optionally make-up solvent;

transferring the mixture to a primary settler in which a primary deasphalted/desulfurized oil phase and a primary asphalt phase are formed;

transferring the primary deasphalted/desulfurized oil phase to a secondary settler in which a secondary deasphalted/desulfurized oil phase and a secondary asphalt phase are formed;

recycling the secondary asphalt phase to the primary settler to recover additional deasphalted/desulfurized oil;

conveying the secondary deasphalted/desulfurized oil phase to a deasphalted/desulfurized oil separation zone to obtain a recycle solvent stream and a substantially solvent-free deasphalted/desulfurized oil phase stream;

conveying the primary asphalt phase is conveyed to a separator vessel for flash separation of an additional recycle solvent stream and a bottom asphalt phase, wherein the substantially solvent-free deasphalted/desulfurized oil phase stream is the feed to the coker unit.

20. The process as in claim 1, wherein the deasphalted/desulfurized oil phase is solvent-soluble, and wherein the petroleum green coke has a sulfur content of no greater than 3.5 w %.

* * * * *